United States Patent [19]

Reinbold

[11] Patent Number: 4,875,846

[45] Date of Patent: Oct. 24, 1989

[54] SPINNING APPARATUS

[76] Inventor: Heinz Reinbold, Petersbergstrasse 5, 5200 Siegburg/Kaldauen, Fed. Rep. of Germany

[21] Appl. No.: 86,081

[22] PCT Filed: Nov. 14, 1986

[86] PCT No.: PCT/DE86/00467

§ 371 Date: Aug. 28, 1987

§ 102(e) Date: Aug. 28, 1987

[87] PCT Pub. No.: WO87/03017

PCT Pub. Date: May 21, 1987

[30] Foreign Application Priority Data

Nov. 16, 1985 [DE] Fed. Rep. of Germany ..... 3540757

[51] Int. Cl.[4] ..... B29C 47/12

[52] U.S. Cl. ..... 425/186; 425/192 S; 425/198; 425/199; 425/378.2; 425/382.2; 425/464

[58] Field of Search ..... 72/253.1; 137/89, 101; 210/234, 334; 425/72.2, 183, 184, 185, 186, 192 S, 197, 198, 199, 378.2, 379 S, 382.2, 464

[56] References Cited

U.S. PATENT DOCUMENTS

| | | | |
|---|---|---|---|
| 1,905,733 | 4/1933 | Moore | 137/101 |
| 2,803,851 | 8/1957 | Braunlich | 425/191 |
| 3,416,190 | 12/1968 | Mehnert | 425/378 R |
| 3,479,692 | 11/1969 | von den Biggelaar | 425/198 |
| 3,707,341 | 12/1972 | Fontijn et al. | 425/198 |
| 3,762,854 | 10/1973 | Kilsdonk | 425/382.2 |
| 3,804,758 | 4/1974 | Cooper et al. | 425/185 |
| 3,891,379 | 6/1975 | Lenk | 425/382.2 |
| 3,938,925 | 2/1976 | Lees | 425/198 |
| 3,947,202 | 3/1976 | Goller et al. | 425/183 |
| 3,970,417 | 7/1976 | Page | 425/72.2 |
| 4,025,434 | 5/1977 | Mladota | 425/197 |
| 4,652,410 | 3/1987 | Inoue et al. | 425/186 |

FOREIGN PATENT DOCUMENTS

| | | | |
|---|---|---|---|
| 1203417 | 9/1961 | Fed. Rep. of Germany . | |
| 1435606 | 10/1964 | Fed. Rep. of Germany . | |
| 1660179 | 4/1967 | Fed. Rep. of Germany . | |
| 1966565 | 2/1969 | Fed. Rep. of Germany . | |
| 2627453 | 6/1976 | Fed. Rep. of Germany . | |
| 203336 | 1/1982 | Fed. Rep. of Germany . | |
| 3334870 | 9/1983 | Fed. Rep. of Germany . | |
| 1520059 | 4/1968 | France | 425/198 |
| 60-199907 | 10/1985 | Japan | 425/72.2 |
| 445840 | 3/1968 | Switzerland | 425/198 |

OTHER PUBLICATIONS

Pat. Abstracts of Japan C-287, Jun. 20, 1985, Band 9 Nr. 145.

*Primary Examiner*—Richard L. Chiesa
*Assistant Examiner*—C. Scott Bushey
*Attorney, Agent, or Firm*—Walter A. Hackler

[57] ABSTRACT

Spinning apparatus for the production of monofilament yarn includes a spinning tool having a flow channel in the form of a flattened U for providing polymer melt to a group of nozzles, the flow channel having a cross-sectional area which becomes larger, at least in an upper part thereof, in a direction of polymer melt flow therethrough.

16 Claims, 8 Drawing Sheets

SPINNING APPARATUS

BACKGROUND OF THE INVENTION

The invention relates to a spinning system for the production of monofilament yarn, in which a spinning tool comprises a channel section for a polymer melt, said channel section expanding widthwise in a channel portion of the spinning tool into a flow channel in the form of a flattened U (or T-die) and connected to a group of nozzles.

Such a spinning tool is known from DE-B No. 33 34 870.

Such spinning systems are used to spin from polymer melts high-grade yarn, which, owing to its application, e.g. for filter fabrics, breast harnesses, fishing lines etc., must have constant material characteristics within a close tolerance range. The production of a high- pressure-compatible, close-meshed filter fabric requires yarn, firstly, of a constant diameter and, secondly, of a high tearing strength.

With the known spinning system of the kind described in the aforementioned patent specification, the uniform delivery volume of a polymer melt along a two-dimensional channel is provided for by a flow-regulating bar, the variable distance of which from a wall of the two-dimensional channel regulates the volume of polymer melt passing through. Accordingly, the flow-regulating bar must be flexible or must consist of several individual elements, so that it is able lengthwise to form a variable gap with the wall. The polymer melt is accumulated in the two-dimensional channel by the flow-regulating bar, and, according to its set distance from the wall, a defined amount of polymer melt is able to pass through a set gap per unit time.

The flow-regulating bar must be sealed with particular care because of the high product and housing temperatures occurring in the production of monofilament yarn. This is particularly difficult to achieve at temperatures around approx. 300° C. There is also the fact that, as is known, sealing elements of moving machine parts are also more susceptible to malfunction at raised temperatures. If materials undergo different degrees of expansion, the gap between flow-regulating bar and wall must be re-adjusted during operation. This calls for an elaborate monitoring unit for the gap width between wall and flow-regulating bar.

The object of the invention, therefore, is to further develop the spinning system of the aforementioned kind to the extent that, with laminar flow and without separation of flow, the polymer melt is distributed constantly and uniformly over the entire free space of the flattened-U-shaped channel or T-die so that, with maximum reliability of production, the group of nozzles is supplied over its entire width with a constant mass flow of polymer.

SUMMARY OF THE INVENTION

The object of the invention is achieved in that a cross-sectional area of the flow channel is increased normal to the width of the latter at least in the upper part of the channel section and in that the flow channel is kept free from incrustations.

The spinning system according to the invention thus has the considerable advantage that, through the shaping of the flow channel, the mass flow of polymer is distributed uniformly over the entire channel. The three-dimensional contour of the flow channel is designed as a function of the viscosity and the stress-strain curve of a raw material that is to be processed, such that the polymer melt has a constant flow velocity over the entire outlet cross-section of the flow channel.

The flow channel has the further advantage that it is free from incrustations and thus does not have any protruding edges that might disrupt or change the flow profile of the polymer melt in the flow channel. This design guarantees maximum operational reliability and ease of maintenance, since the flow channel does not contain any adjustable built-in components and any sealing problems resulting therefrom can be ruled out.

It is likewise possible to develop the three-dimensional contour of the flow channel for various materials with different viscosities and stress-strain curves. If, however, polymer melts with very different product characteristics are used in the spinning tool, then the flow channel must be exchanged in accordance with the product characteristics of the raw material.

In a further embodiment of the invention, the cross-sectional area tapers toward the group of nozzles and joins into an opening, said opening being of constant width over its entire breadth.

This embodiment of the flow channel guarantees that the rectangular plates with linearly disposed holes or nozzle openings can easily be connected to the outlet crosssection of the flow channel. The width of the tapered opening results from the output of the spinning tool.

Furthermore, the flow channel is formed preferably by the joining-together of a first and a second channel portion, with a three-dimensional contour of the flow channel being formed on at least one of the insides of the channel portions.

The fact that the flow channel consists of a two-shell construction permits the very simple and precise production of the three-dimensional contour of the flow channel. Thus, the contour can be numerically calculated for specific product characteristics, and a numerically controlled machine tool then mills the calculated three-dimensional contour into at least one of the channel portions in the form of metal blocks. Additionally, it is possible with a two-shell construction further to machine or to chromium-plate the surfaces of the flow channel, so that there are particularly smooth surfaces. If the polymer melt is allowed to solidify in the spinning tool, it is possible, when removing the channel portions, to remove from the flow channel a solidified polymer body that shows the full shape of the channel that is being flowed through. This makes it possible to inspect the distribution of the polymer melt particularly easily in cases where several melts are being processed with one single flow-channel contour.

In a further embodiment of the invention, the group of nozzles is part of a pack of nozzles, said pack of nozzles comprising a nozzle-insert lower part, said nozzle-insert lower part accommodating the group of nozzles, a perforated plate, a strainer and a nozzle insert upper part.

The modular design of the pack of nozzles permits the separate exchanging of the individual components. Groups of nozzles with different nozzle shapes may be used. Depending on the arrangement of the nozzles, a perforated plate that is matched to the group of nozzles distributes the polymer melt and supplies it to the individual nozzles. Depending on the polymer melt, strainers of different pore size on a metal-fabric base are disposed above the perforated plate and filter out dirt particles from the polymer melt. The holes in the nozzle-insert upper part provide the pre-distribution of the polymer melt in the pack of nozzles. The interaction of the individual components in the pack of nozzles results in a further uniformization of the polymer flow while simultaneously prolonging the service life of the nozzles and increasing the reliability of spinning during production.

In an embodiment of the invention, the spinning tool is enclosed widthwise on two sides by clamping plates, said clamping plates embracing the group of nozzles on a third side normal to the two sides and pressing said group of nozzles against the channel portion.

This makes it possible in simple manner separably to connect the channel portion to the nozzles. The clamping plates and the nozzle-insert lower part guarantee on the broad side of the group of nozzles that the heat-radiation losses in the area of the group of nozzles are as low as possible. Temperature gradients are, therefore, negligibly small over the entire width of the group of nozzles.

In a further embodiment of the invention, at their ends embracing the pack of nozzles, the clamping plates for the guiding of the pack of nozzles comprise jaws normal to the plane of the strainer. In this connection, in a special embodiment, the jaws are in the form of dovetail connections, said dovetail connections co-operating with the nozzle-insert lower part.

The channel portions, which can be heated and controlled by known devices, are protected by the clamping plates covering them, and their heat radiation is inhibited. The method of connection of the nozzle-insert lower part to the jaws of the clamping plates results in a linear contact pressure between the group of nozzles and the adjoining components, said linear contact pressure, in contrast to point contact pressure by means of throughbolts, pressing the group of nozzles uniformly against the channel portions. The transfer of heat from the heated channel portions to the group of nozzles and to the components surrounding them is thus particularly good. Furthermore, the method of connection means that the group of nozzles is guided particularly safely and evenly.

In a preferred embodiment of the invention, to release the group of nozzles from the channel portions, the clamping plates are vertically displaceable with respect to the channel portions, and the jaws extend laterally beyond the clamping plates and join into guide rails, the group of nozzles being guidable in said guide rails as far as outside the spinning tool.

This has the advantage that the group of nozzles can be quickly exchanged. This prevents lengthy downtimes of a spinning system and increases the economic efficiency of a production plant.

In a preferred embodiment of the invention, the channel portion is separably connected to a carrier, said carrier being attached to a vertically displaceable mount, said mount running in a spatially fixed and horizontal rail.

The spinning tool is thus height-adjustable in the vertical direction and is horizontally displaceable via a rail with respect to a fixed point in space. This makes it possible easily to adjust the heavy spinning tool with respect to connectable systems.

In a further embodiment of the invention, the end faces of the carrier comprise clamping devices, said clamping devices engaging the clamping plates.

A particularly practical method has proven to be a clamping connection with eccentrics by which the clamping plates are displaceable in the vertical direction.

The use of eccentrics has the advantage that, when the new pack of nozzles is re-clamped in position, its connection is self-clamping, so that, even if the switching elements operating the eccentrics fail, the group of nozzles does not come away from the channel portions.

In a further embodiment of the invention, the spinning tool is of such design that two or more groups of nozzles, flow channels and channel sections are contained in the spinning tool.

The use of a second pack of nozzles makes it possible to employ different nozzle shapes in one spinning tool. Thus, monofilament yarns of different qualities can be produced simultaneously with one single spinning tool.

In a preferred embodiment of the invention, a metering unit is connectable with its outlet to the inlet side of the spinning tool, said metering unit delivering the polymer melt into the spinning tool.

The spinning tool is adjusted to the position of the metering unit. This permits the fast and accurate connection of the two systems. The spinning tool or the metering unit can be exchanged as a complete unit. The distribution and/or delivery characteristics of a polymer melt can easily be changed.

In a preferred embodiment of the invention, the metering unit consists of a divisible housing block, said housing block accommodating a spinning pump subject to a throughflow in the flow direction of the polymer melt, a static mixer being adapted to be integrated into the outlet of the spinning pump.

The spinning pump with the static mixer is inserted in the flow direction of the polymer into recesses of the housing block such that the divisible housing parts guarantee the exact positioning of the spinning pump. The fast, simple exchanging of the spinning pump with the static mixer is possible also when the spinning system is hot, since the delivery of the polymer melt in the spinning pump takes place in the mass-flow direction and no additional fastening screws are required between housing block and spinning pump.

The spinning pump accepts the polymer melt without diversion within the pump and delivers it, precisely metered, through the integral static mixer to the flow channel of the spinning tool. Thanks to a high mixing capacity, the static mixer compensates for even minimal temperature fluctuations in the polymer melt and guarantees that the polymer melt flows at a uniform temperature into the flow channel of the spinning tool.

The divisible housing block can be heated and controlled by known means, for example by a controlled resistance heater. This has the advantage that the spinning pump with the integral static mixer has a uniform temperature.

In an embodiment of the invention, the spinning pump with the static mixer is adapted to be inserted as a self-contained unit into the housing block.

This has the advantage that it is not necessary to adapt the two functional parts to one another in the spinning system. This facilitates particularly the installation of this spinning pump under difficult conditions, i.e. for example, when the spinning system is hot or when the space available is confined.

In a further embodiment of the invention, the respective channel sections of the spinning tool are each supplied with the polymer melt by a spinning pump with an infinitely variable spinning-pump drive. This makes it possible to compensate for a range of fluctuation in the delivery accuracy of individual spinning pumps, and a uniform, constant mass flow of the polymer melt is guaranteed in all channel sections.

If, in a preferred embodiment of the invention, the metering unit is spatially fixed, this has the advantage that, when the spinning system is stopped, the spinning tool can be separated quickly and simply from the metering unit by way of its horizontal displacement capabilities. This ensures short inspection and changeover times on the spinning system.

In a further preferred embodiment of the invention, the metering unit forms the connection of the channel section between the inlet of the spinning tool and an outlet of a polymer distributor.

The polymer distributor consists of a first distributor piece and of a second distributor piece, said distributor pieces being exchangeable, the polymer flow being able to be split into several side channels by said distributor pieces.

This has the advantage that, prior to its entry into the spinning tool, the polymer melt can be precisely metered and once again intensively mixed.

The splitting of the polymer channel into several side channels makes it possible for the polymer melt to flow into several separate metering units, which, in turn, supply the polymer melt, metered, into different flow channels of a spinning tool or into different spinning tools with different flow channels. A reduction or increase in the throughput of a spinning system can easily be obtained, also retrospectively, by exchanging the distributor pieces and the packs of nozzles or their individual components. When the production output is being raised for monofilament yarn, further spinning systems can be connected additionally to two existing spinning systems.

In a further embodiment of the invention, the inlet of the polymer distributor is connected to an outlet of a central melt filter, and the melt filter is provided with packs of strainers, said packs of strainers being exchangeable during operation, as is known.

The use of a melt filter upstream of the polymer distributor, the metering unit and the spinning tool considerably raises the production reliability of a spinning system. Impurities in the polymer melt are already largely trapped in the melt filter, and the burden on the strainer in the pack of nozzles is extensively reduced, so that there is a substantial improvement in the service life of a pack of nozzles. If the polymer melt is pre-filtered, the metal-fabric-based strainer in the pack of nozzles may be selected to have finer pores, thus improving the quality of the polymer melt which is spun into monofilament yarn. The exchanging of dirty packs of strainers during operation considerably increases the degree of utilization of the capacity of such a spinning system.

In a preferred embodiment of the invention, the melt filter in a strainer housing comprises a piston, said piston being displaceable at an angle to the polymer channel and being provided with a first strainer recess and a second strainer recess, said strainer recesses being equipped with the packs of strainers.

This embodiment makes it possible to move the piston without disrupting the mass flow of the polymer melt in the spinning system.

Furthermore, the melt filter preferably comprises preflooding channels in the strainer housing, said preflooding channels, with the piston in a first and a third position, being sealed and, with the piston in a second position, providing a through-connection between the inlet side of the polymer channel and the strainer recesses.

With the piston in the first and third positions, one of the two strainer recesses is always fully in the mass flow of the polymer melt, while the other strainer recess is outside the melt flow. Consequently, it is always possible for one strainer recess to be cleaned and for a pack of strainers to be exchanged without the mass flow in the spinning system being interrupted.

In a further embodiment of the invention, with the piston in the second position, one of the two strainer recesses has a through-connection on the inlet and outlet sides to the polymer channel; the other strainer recess has a through-connection to the polymer channel only on the inlet side, said strainer recess additionally having a through-connection to inlet- and outlet-side ventilation channels in the housing.

This has the advantage that each strainer recess is completely full with polymer melt even before it is guided into the polymer flow by a movement of the piston. The preflooding of the strainer recess that is outside the melt flow guarantees that the exchanging of a pack of strainers during operation does not detract from the production quality of the monofilament yarn.

In a further embodiment of the invention, the piston is displaceable into a position providing a through connection between the inlet and outlet sides of one of the two strainer recesses and the polymer channel, the other of the two strainer recesses having a through-connection to the polymer channel only on the inlet side and being connected only to the outlet-side ventilation channel.

This has the advantage that, during preflooding, the respective strainer recess and its pack of strainers can be vented gradually. While, with the piston in the second position, preferably the inlet-side part of the strainer recess is vented and is subject to a throughflow of polymer melt, with the piston in the described position, the polymer melt flows through the entire strainer recess. The strainer recess in question and the polymer melt are completely vented and are free from gas inclusions.

In a further embodiment of the invention, the spinning tool, the metering unit, the polymer distributor and the melt filter are in the form of individual modules and are separable from one another.

BRIEF DESCRIPTION OF THE DRAWINGS

This allows the simple modernization of existing systems, since individual modules can be integrated into them independently of one another.

Further advantages will become apparent from the description and from the appended drawings.

Figure 1:
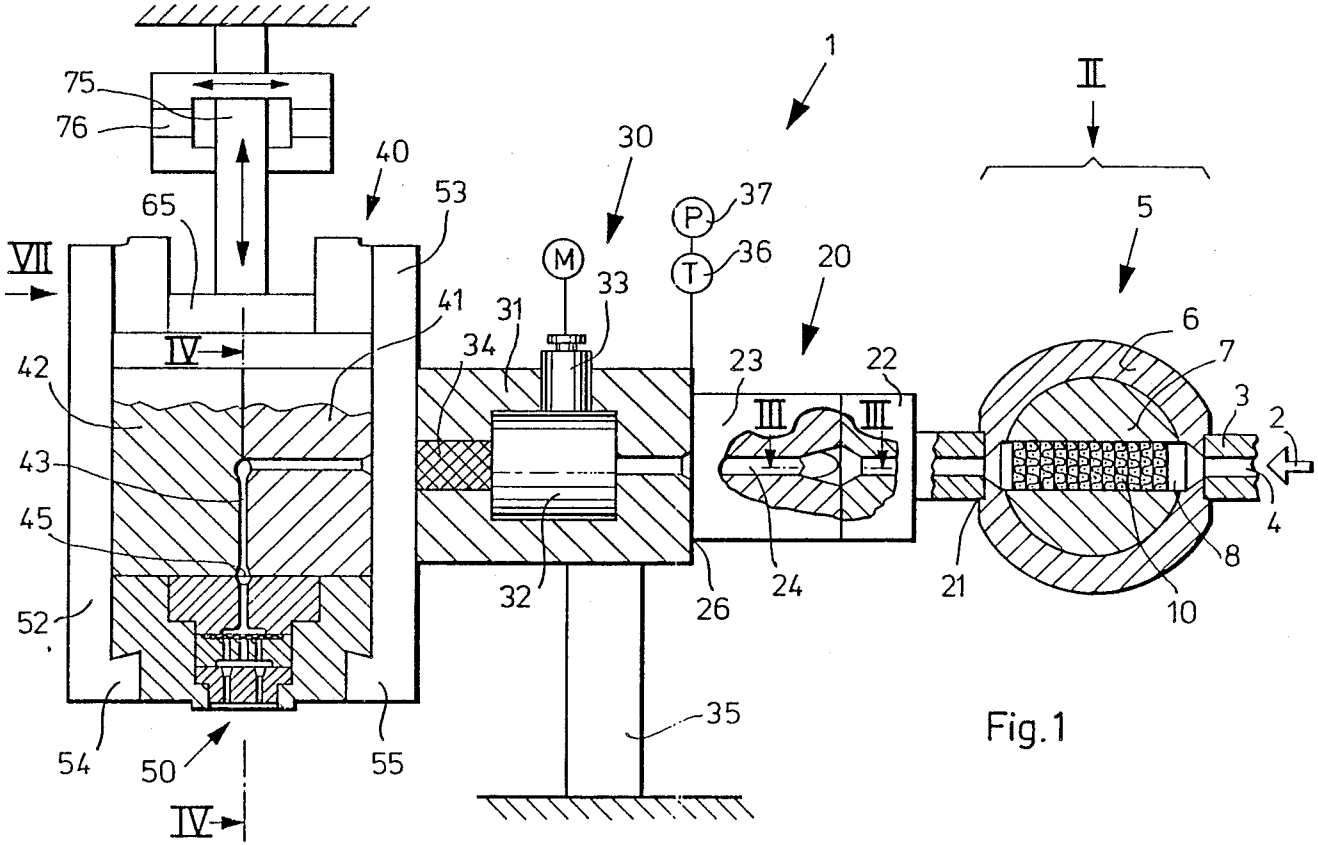
Figure 2B:
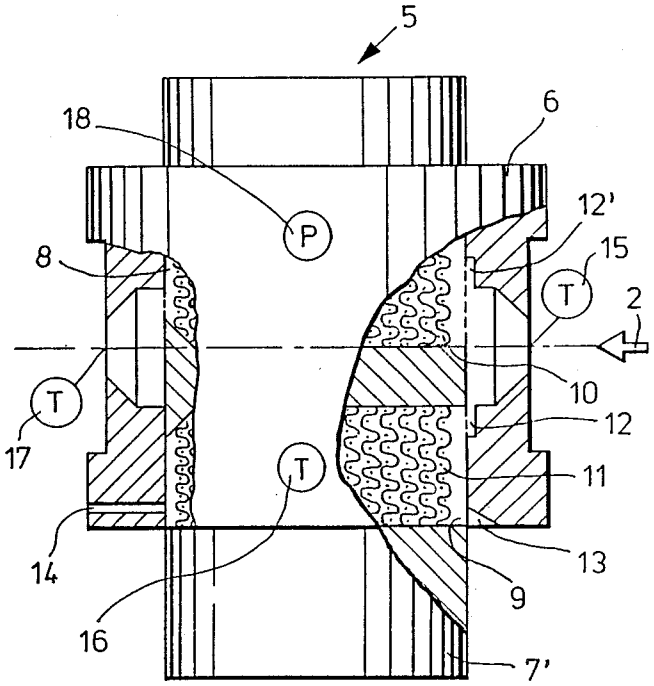
Figure 2A:
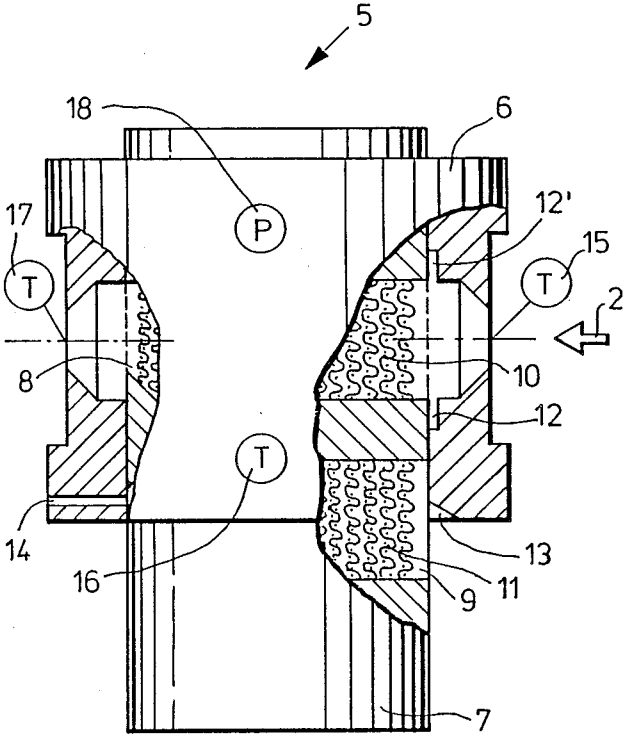
Figure 2C:
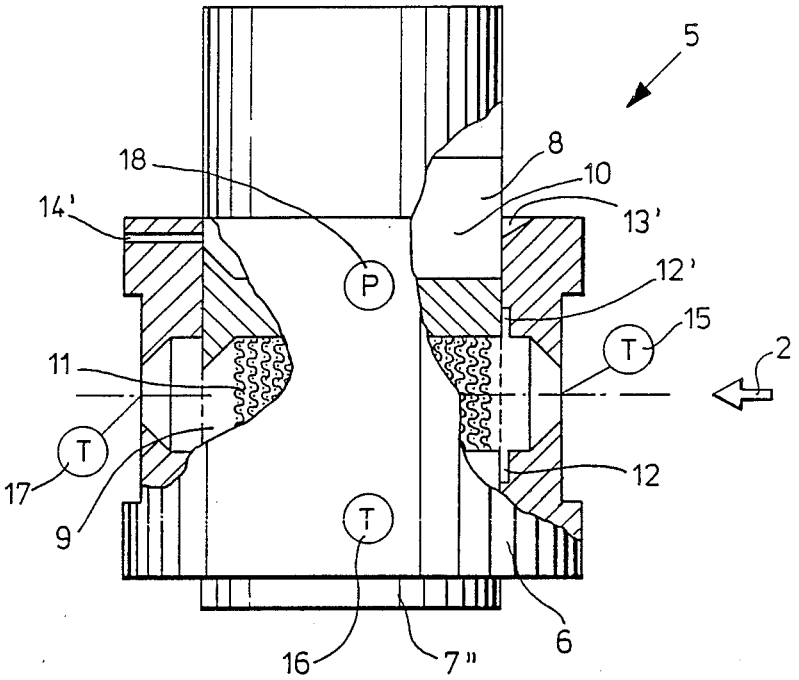
Figure 3A:
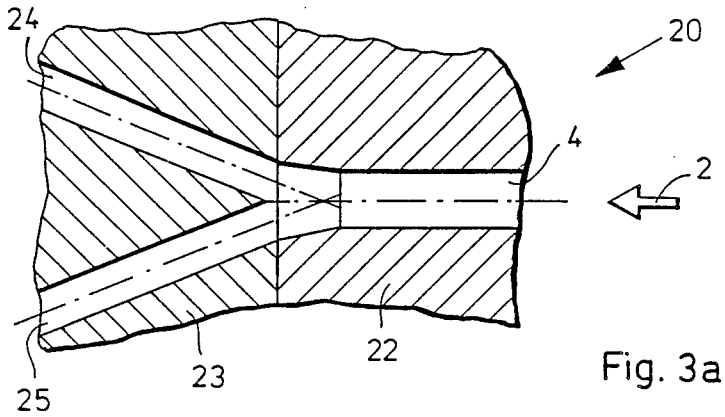
Figure 3B:
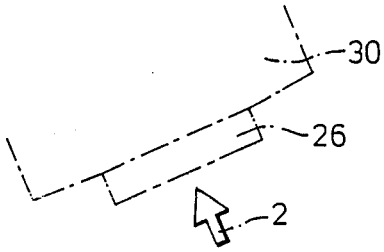
Figure 3B:
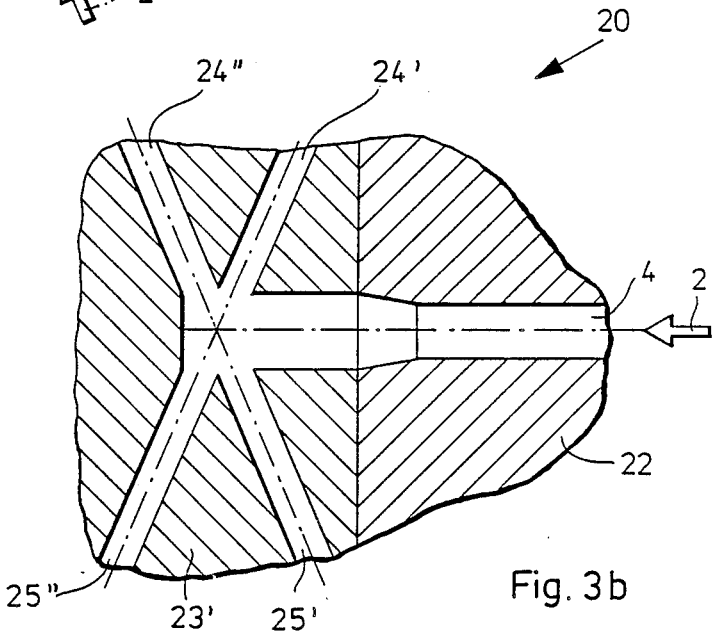
Figure 4:
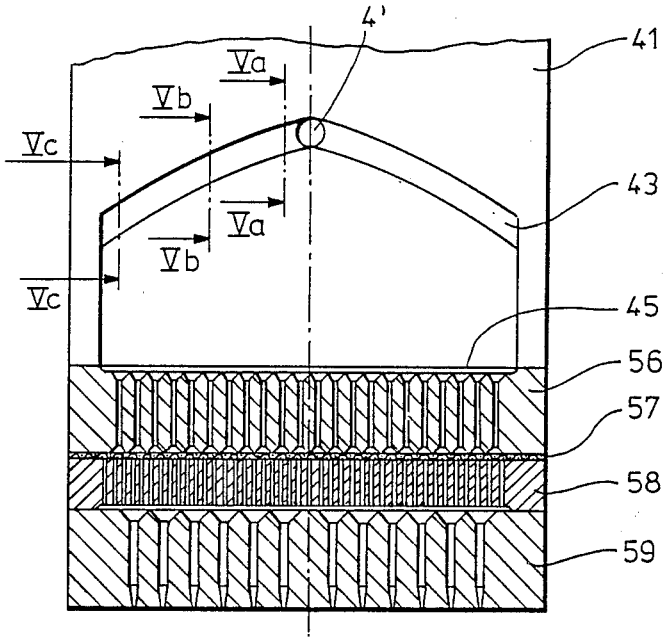
Figures 5A, 5B, 5C:
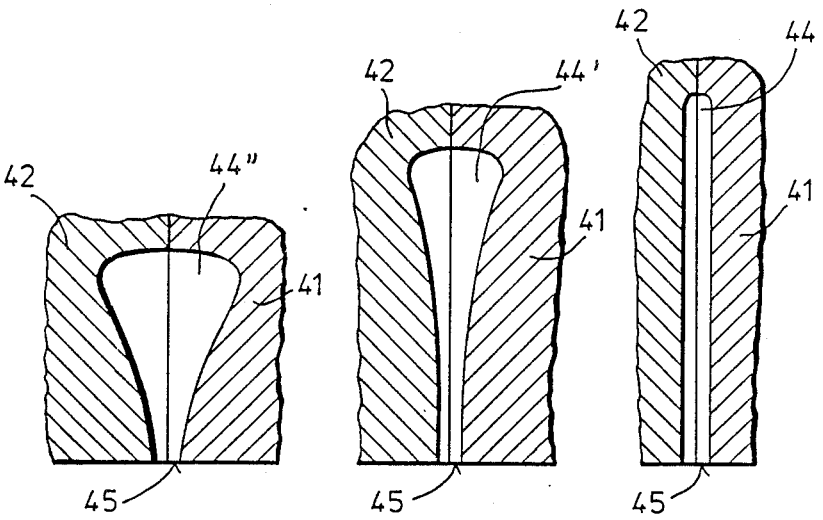
Figure 6:
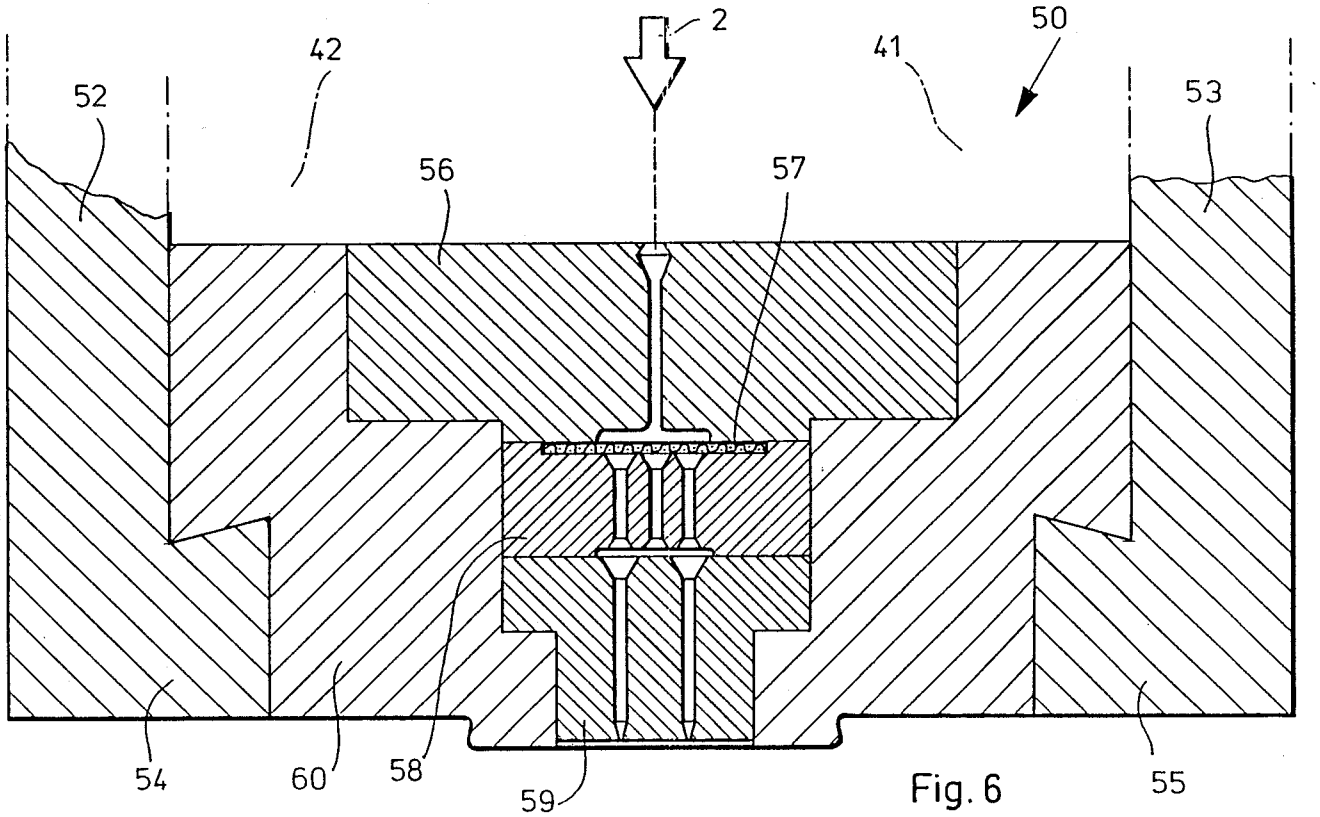
Figure 7A:
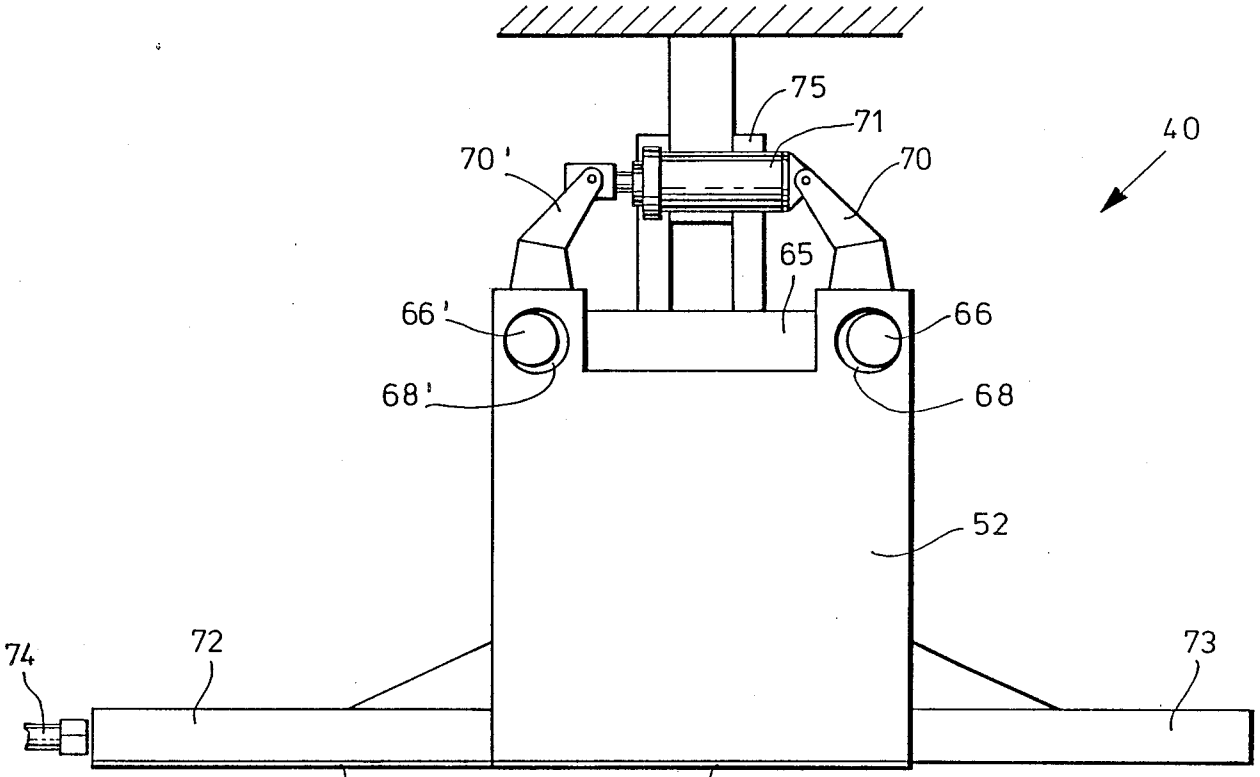
Figure 7B:
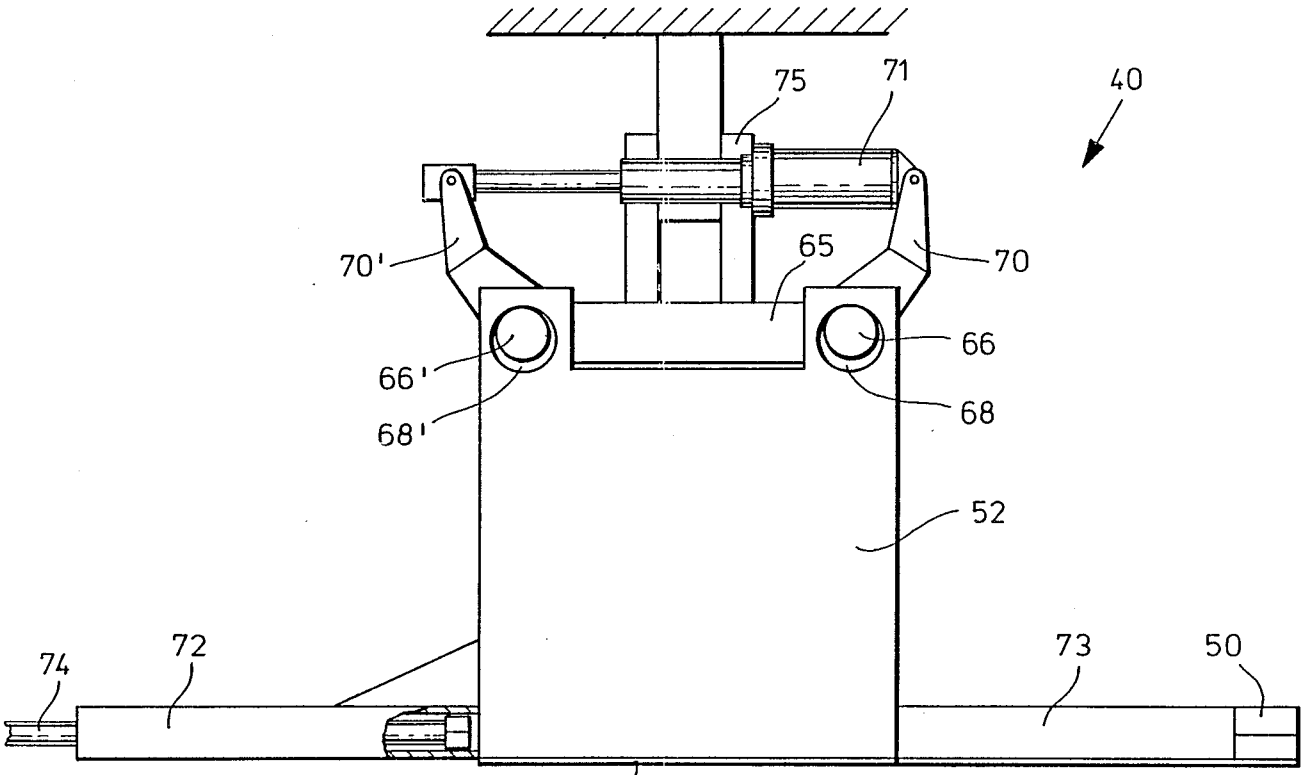

The invention is shown in the drawings and is described in greater detail with reference to specimen embodiments in the drawings, in which:

FIG. 1 shows a lateral basic representation, partially cut away, of a specimen embodiment of a spinning system according to the invention;

FIG. 2*a* to 2cshow different working positions of a melt filter of the spinning system according to FIG. 1;

FIG. 3*a*, 3*b* show specimen embodiments of a polymer distributor in a top view in section III—III according to FIG. 1;

FIG. 4 shows a spinning tool in a sectional representation IV—IV, on an enlarged scale, according to FIG. 1;

FIG. 5*a* to 5*c* show a flow-channel profile according to positions Va-Va, Vb-Vb, Vc-Vc in FIG. 4;

FIG. 6 shows a sectional representation of the pack of nozzles, on an enlarged scale, according to FIG. 1;

FIG. 7*a* shows a front view of a closed spinning tool with a new pack of nozzles in a guide rail;

FIG. 7*b* shows a front view of an open spinning tool with a dirty pack of nozzles in a guide rail;

DETAILED DESCRIPTION OF THE INVENTION

FIG. 1 shows a spinning system 1 which is subject to a throughflow by a polymer melt 2. A connecting pipe 3 with a polymer channel 4 connects the spinning system 1 on the inlet side to a dynamic mixer (not shown) and an extruder, which supply the spinning system 1 with the liquid polymer melt 2.

Connected to the connecting pipe 3 is a melt filter 5, which consists of a housing 6 and a piston 7, said piston 7 being displaceable in the housing 6. The piston 7 contains strainer recesses 8, which are equipped with packs of strainers 10.

The polymer melt 2 flows through the melt filter 5, which filters out impurities in the polymer melt 2. By moving the piston 7, it is possible to exchange a dirty pack of strainers 10 while the spinning system 1 is in operation. The mass flow of the polymer melt 2 is not interrupted when the pack of strainers 10 is being exchanged. Various operating conditions of the melt filter 5 will be explained in the following with reference to FIG. 2*a* to 2*c*.

The polymer melt 2 flows out of the melt filter 5 into a polymer distributor 20, which is separably connected to the melt filter 5 by a first flange connection 21. The polymer distributor 20 splits the polymer channel 4 into side channels 24, of which only one is shown in FIG. 1. The polymer melt 2 can be distributed homogeneously and uniformly between the side channels 24. Two specimen embodiments of the polymer distributor 20 will be explained in the following by way of example with reference to FIG. 3*a* and 3*b*.

From the side channels 24, the polymer melt 2 flows into metering units 30, of which FIG. 1 shows only one, which are each connected on the outlet side to second flange connections 26 of the side channels 24 of the polymer distributor 20. In their divisible housing blocks 31, the metering units 30 accommodate a spinning pump 32, which is equipped with an infinitely variable spinning-pump drive 33. A static mixer 34 can be integrated into the outlet of the spinning pump 32. The metering units 30 are spatially fixed by way of mounting brackets 35. The polymer melt 2 flows in each individual metering unit 30 without diversion, precisely metered in volume, into the static mixer 34. The static mixer 34 compensates for inhomogeneities and temperature gradients in the polymer melt 2.

The spinning system 1 is so designed that a temperature 36 and a pressure 37 of the polymer melt 2 are measured on the inlet side at the metering unit 30. This makes it possible to keep constant the pressure 37 of the polymer melt 2 directly before the spinning pump 32, irrespective of the degree of fouling of the packs of strainers 10 in the melt filter 5 or any other pressure losses. The pressure 37 of the polymer melt 2 is checked at the spinning-pump inlet and a feedback signal to upstream devices, such as the extruder, is processed as a controlled variable, such that the pressure 37 of the polymer melt 2 at the spinning-pump inlet is constant. A comparable control apparatus is provided for the temperature 36 of the polymer melt 2 at this point in the spinning system 1.

The spinning pump 32 with the integrated mixer 34 is inserted preheated into the divisible housing block 31 of the metering unit 30. No additional fixing or adjusting is necessary for the operation of the spinning pump 32. Thus, the spinning pump 32 can be exchanged quickly and easily for e.g. maintenance purposes.

The polymer melt 2 flows from the metering unit 30 into a channel section 4' of a spinning tool 40 connected to the metering unit 30. The spinning tool 40 contains a first channel portion 41 with one or more channel sections 4'. The channel section 4' expands in the first channel portion 41 and/or in a second channel portion 42 into a flow channel 43. The second channel portion 42 is separable from the first channel portion 41. In its opposite contact surfaces, the flow channel 43 is in the form of a flattened U or T-die. The flow channel 43 distributes the polymer melt 2 uniformly over its width. For this purpose, the flow channel 43 is provided widthwise with a changing three-dimensional contour. This is explained in the following with reference to FIG. 4 by way of example for the first channel portion 41 on section IV—IV in FIG. 1. Likewise, FIG. 5*a* to 5*c* will show further specimen embodiments of how cross-sectional areas 44, 44', 44" may be formed, which are created by the joining-together of the two channel portions 41, 42.

Homogeneously and uniformly distributed over the entire width of the flow channel 43, the polymer melt 2 in FIG. 1 flows to an opening 45 at the lower end of the flow channel 43, said opening 45 being of constant width over its entire breadth.

A pack of nozzles 50 is pressed against the opening 45 by a first and a second clamping plate 52, 53. The clamping plates 52, 53 embrace the channel portions 41, 42 on their broad sides and are displaceably in contact with said sides. At the ends embracing the pack of nozzles 50, the clamping plates 52, 53 are in the form of jaws 54, 55, which embrace the pack of nozzles 50 normal to the sides of the clamping plates 52, 53 and press the pack of nozzles 50 against the channel portions 41, 42.

In the pack of nozzles 50, the polymer melt 2 is divided uniformly into filaments which then leave the spinning tool 40 and are supplied to the downstream equipment. With reference to FIG. 6, the distribution of the polymer melt 2 is described in greater detail on the basis of a sectional representation of the pack of nozzles 50.

In FIG. 1, the spinning tool 40 is separably connected by a carrier 65 to a vertically adjustable mount 75, which is horizontally displaceable in a spatially fixed rail 76.

In FIG. 2*a* to 2*c* the melt filter 5 is shown in various operating positions. The melt filter 5 consists of the strainer housing 6, the piston 7, 7', 7", the first strainer recess 8, a second strainer recess 9, the packs of strainers 10, 11, preflooding channels 12, 12' and inlet- and outlet-side ventilation channels 13, 13', 14, 14'.

Depending on the operating position of the melt filter 5 in FIG. 2*a*, the polymer melt 2 flows through an opening in the strainer housing 6. The strainer housing 6 is controllably heated, so that the piston 7, the strainer recesses 8, 9 and the packs of strainers 10, 11 are at the same temperature as the polymer melt 2. A temperature 15, 16, 17 of the polymer melt 2 is measured in the mass flow, at the inlet into the melt filter 5, in the melt filter 5 and at the outlet from the melt filter 5. These temperature-measuring points serve as a controlled variable for the heating of the strainer housing 6. The opening of the strainer housing 6 on the inlet side of the polymer melt 2 expands on the inside toward the piston 7 and leads into the preflooding channels 12, 12'. With the piston 7 in the operating position, the preflooding channels 12, 12' are sealed by the surface of the piston 7, and the polymer melt 2 can flow into the strainer recess 8 with the exchangeable pack of strainers 10 only through an opening in the piston 7. The polymer melt 2 is cleaned of dirt particles as it flows through the pack of strainers 10.

If a critical level of fouling of the pack of strainers 10 is indicated at the melt filter 5 by a pressure indicator 18 with max.-value contact, the piston 7 is moved into the operating position piston 7' according to FIG. 5*b*, and the polymer melt 2 now flows only partially through the strainer recess 8 with the pack of strainers 10. The mass flow of the polymer melt 2 is not interrupted. With the piston 7' in the operating position, the preflooding channel 12 and a segment of the strainer recess 9 are in alignment. The polymer melt 2 thus flows simultaneously into the first and second strainer recesses 8, 9. Via the inlet-side ventilation channel 13 in the strainer housing 6, which, with the piston in position piston 7', connects the strainer recess 9 to the outside of the melt filter 5, the polymer melt 2 is able to escape from the melt filter 5, with the strainer recess 9 being partially vented. Subsequently, the piston 7' moves into a position in which the piston surface seals the inlet-side ventilation channel 13 but still connects the outlet-side ventilation channel 14 to the strainer recess 9. With an uninterrupted mass flow in the strainer recess 8, the polymer melt 2 now likewise flows through the entire pack of strainers 11 of the strainer recess 9 and completely vents the strainer recess 9. When the strainer recess 9 is full with the polymer melt 2, the latter flows through the outlet-side ventilation channel 14 out of the melt filter 5.

The piston 7' then moves into the operating position piston 7'' according to FIG. 2*c*, and the changeover from the dirty pack of strainers 10 to a new, clean pack of strainers 11 is completed. The dirty pack of strainers 10 can be pressed out of the strainer recess 8 for cleaning. When the pack of strainers 10 has been cleaned and preheated, it can be re-inserted into the strainer-recess 8.

If necessary, the packs of strainers can now be changed over again in the opposite direction. The strainer recess 8 is filled via the preflooding channel 12' and is vented via the inlet-side ventilation channel 13' and then via the outlet-side ventilation channel 14' before the melt filter 5 again assumes the operating position piston 7 according to FIG. 2*a*.

FIG. 3*a* and 3*b* show, by way of example, two embodiments of the polymer distributor 20 in section III—III according to FIG. 1.

In FIG. 3*a*, the polymer distributor 20 is composed of a first distributor piece 22 with the polymer channel 4 and of a second distributor piece 23 with the side channels 24, 25. The polymer melt 2 is split into two sub-flows which flow in the side channels 24, 25. The sub-flows are supplied via two metering units 30 to one or two separate spinning tools 40. If the sub-flows of the side channels 24, 25 are supplied to one spinning tool 40, this spinning tool 40 is equipped with two channel sections 4' and two separate flow channels 43, which supply two separate packs of nozzles 50, 50'.

FIG. 3*b* shows a polymer distributor 20 which is equipped with the first distributor piece 22 and a second distributor piece 23'. In the distributor piece 23', the polymer melt 2 from the polymer channel 4 of the distributor piece 22 is split into four sub-flows which flow in the side channels 24', 24'', 25', 25''. These sub-flows are supplied via four metering units 30 to the spinning tools 40. The sub-flows can be processed in two so-called "double spinning tools" or in four spinning tools 40.

The polymer distributor 20 consists of a divisible housing which can be controllably heated. The distributor pieces 22, 23, 23', which can be inserted into the polymer distributors 20, may consist of polymer channels 4 and side channels 24, 24', 24'', 25, 25', 25'' of different diameters. This may be necessary if the spinning system 1 is to be operated with different outputs.

FIG. 4 shows the section IV—IV according to FIG. 1 of the spinning tool 40. The channel section 4' in the channel portion 41 joins at 90° into the flow channel 43, which has the shape of a flattened U. The closed three-dimensional contour of the flow channel 43 is created by the joining-together of the channel portions 41, 42. The shape of the flow channel 43 is calculated from the stress-strain curve of the polymer melt 2 to be processed and from its product characteristics. The three-dimensional contour is numerically calculated so that, in the flow channel 43, at constant flow velocity, the polymer melt 2 is uniformly distributed over the width of the flow channel 43 and flows at constant flow velocity into the opening 45 of the flow channel 43. For polymer melts 2 with different stress-strain and product characteristics there are different three-dimensional geometries of the flow channels 43 if the distribution of the different polymer melts 2 is uniform in the flow channels 43 and if the polymer melts 2 are to flow out of the flow channels 43 at constant flow velocity. The geometry of a flow channel 43 may be matched to polymer melts 2 such that several polymer melts 2 with similar stress-strain and product characteristics can be uniformally distributed in one single flow channel 43. If however, the polymer melts 2 that are being processed are very different, the channel portions 41, 42 must be exchanged with the flow channel 43.

FIG. 5*a* to 5*c* show, by way of example, the different geometry of the flow channel 43 in section through the channel portions 41, 42 as function of the width of the flow channel 43 according to the positions 5*a* to 5*c* given in FIG. 4. The cross-sectional areas 44, 44', 44'' join into an opening 45 of constant width. It is also possible for the three-dimensional contour of the flow channel 43 to be realized in only one of the channel portions 41, 42 and for the other half of the channel portions 41, 42 to terminate the contour with a smooth, flat surface.

FIG. 6 shows the pack of nozzles 50 according to FIG. 1 in an enlarged sectional representation. The pack of nozzles 50 is limited at the sides by the clamping plates 52, 53 and by the jaws 54, 55, which engage a guide edge of the nozzle-insert lower part 60. The pack of nozzles 50 is composed of the nozzle-insert lower part 60, the group of nozzles 59, the perforated plate 58, the strainer 57 and the nozzle-insert upper part 56, which in the spinning tool 40 adjoins undersides of the channel portions 41, 42. By means of the jaws 54, 55, the pack of nozzles 50 is guided linearly widthwise on both sides. The connection between the jaws 54, 55 and the nozzle-insert lower part 60 may be realized in different manners, for example in the form of a dovetail connection. There is a linear contact pressure between the pack of nozzles 50 and the undersides of the channel portions 41, 42.

The group of nozzles 59 is in the form of a right-angle nozzle in which the nozzle openings are disposed on one or more parallel lines. If there is more than one line, it is practical for there to be a gap between the nozzles. The polymer melt 2 is supplied to the group of nozzles 59 via the perforated plate 58. The holes in the perforated plate 58 distribute the polymer melt 2 uniformly over the right-angle nozzle. The fine-mesh strainer 57, made for example, from metal fabric, is situated above the holes of the perforated plate 58. Minute impurities are filtered out of the polymer melt 2 by this strainer 57. Together with the prefiltering of the polymer melt 2 in the melt filter 5, this results in a high-grade product having particularly good characteristics for spinning into monofilament yarns. The prefiltering of the polymer melt 2 considerably prolongs the service life of the pack of nozzles 50, since the strainer 57 is left to filter out only minute impurities from the polymer melt 2. The polymer melt 2 enters the pack of nozzles 50 through holes in the nozzle-insert upper part 56.

FIG. *7a* and *7b* show front views of the spinning tool 40, closed and open, respectively.

FIG. *7a* shows the front view of the spinning tool 40 with the clamping plates 52, 53 closed, the first clamping plate 52 being on the front side and the second clamping plate 53 (not shown) being on the back side of the spinning tool 40. The pack of nozzles 50 is pressed against the undersides of the channel portions 41, 42 by the clamping plates 52, 53 through the intermediary of the eccentric-type clamping connection (shown as an example). Likewise shown as an example as switching elements for vertical displacement are the counter-rotating clamping levers 70, 70' and a pneumatic cylinder 71. Inserted into the guide rail 72 is a pack of nozzles 50'which, if necessary, with the clamping plates 52, 53 opened, can be inserted into the spinning tool 40 by an insertion device 74 in exchange for a defective or dirty pack of nozzles 50.

FIG. *7b* shows the spinning tool 40 when open. The clamping levers 70, 70' are moved in opposite directions by the extendable pneumatic cylinder 71. Eccentrics 66, 66' on the front side and eccentrics 67, 67' (not shown) on the back side of the spinning tool 40 rotate and the clamping plates 52, 53 are moved downward. A free space is created between the channel portions 41, 42 and the pack of nozzles 50, 50'. The insertion device 74 can be used for inserting into the spinning tool 40 the pack of nozzles 50' (shown in the ready-position in FIG. *7a*) in the guide rail 72. At the same time, the pack of nozzles 50 is forced out of the spinning tool 40 into the guide rail 73. When the pneumatic cylinder 71 is closed again, the spinning tool 40 is ready for operation with the newly inserted pack of nozzles 50'.

I claim:

1. Spinning apparatus for the production of monofilament yarn comprising:

a spinning tool having means defining a channel section for receiving polymer melt; and flow channel means, interconnected between said channel section and a group of nozzles, for widening the flow of polymer melt, said flow channel means having, at least in an upper part thereof, increased cross-sectional area in the direction of polymer flow from the channel section toward the group of nozzles.

2. Spinning apparatus as defined in claim 1, wherein said flow channel means terminates at a slot opening, the cross-sectional area tapers toward the slot opening and said slot opening has a constant width.

3. Spinning apparatus as defined in claim 1 wherein the flow channel means is formed by the joining-together of a first and a second channel portion with a three-dimensional contour of the flow channel means being formed into at least one inside surface of the channel portions.

4. Spinning apparatus as defined in claim 2 further comprising nozzle means, including nozzle-insert upper part in fluid communication with said slot opening, for the production of monofilament yarn, said nozzle means further including a group of nozzles, a perforated plate, a strainer and nozzle-insert lower part means for holding said nozzle-insert upper part, strainer perforated and group of nozzles in fluid communication with one another.

5. Spinning apparatus as defined in claim 4 wherein the spinning tool is enclosed widthwise on two sides by clamping plates, said clamping plates embracing the group of nozzles on a third side normal to the two sides and pressing said group of nozzles against the channel portions.

6. Spinning apparatus as defined in claim 5, wherein, the clamping plates for the guiding of the pack of nozzles comprise jaws disposed normal to the plane of the strainer.

7. Spinning apparatus as defined in claim 6, wherein the jaws are in the form of dovetail connections, said dovetail connections cooperating with the nozzle-insert lower part means.

8. Spinning apparatus as defined in claim 5, wherein the clamping plates are displaceable for releasing the group of nozzles from the channel portions.

9. Spinning apparatus as defined in claim 6, wherein the clamping plates are vertically displaceable.

10. Spinning apparatus as defined in claim 6, wherein the jaws extend laterally beyond the clamping plates in the direction of the third side and join into guide rails, the group of nozzles being guidable in said guide rails as far as outside the spinning tool.

11. Spinning apparatus for the production of monofilament yarn comprising:

a spinning tool having channel portion means, in fluid communication with a group of nozzles and defining a channel section interconnected with a flow channel, for receiving a polymer melt and for widening the flow of polymer melt, said flow channel having, at least in an upper part thereof, increased cross-sectional area in the direction of polymer flow toward the group of nozzles;

clamping means for holding the group of nozzles in fluid communication with said channel portion means; and carrier means for supporting said clamping means, said carrier means being attached to a vertically displaceable mount, said mount being disposed for movement along a spatially fixed and horizontal rail.

12. Spinning apparatus for the production of monofilament yarn as defined in claim 11 wherein said flow channel is in the form of a flattened U, said clamping means comprises clamping plate means for enclosing said spinning tool widthwise on two sides thereof, said clamping plate means further embracing the group of nozzles on a third side normal to the two sides of the spinning tool and pressing said group of nozzles against the channel portion means, and said clamping means includes clamping device means for engaging said clamping plate means, said clamping device means comprising end faces of the carrier means.

13. Spinning apparatus as defined in claim 12, wherein the clamping device means on the carrier means comprise eccentrics disposed for engaging holes in the clamping plate means.

14. Spinning apparatus as defined in claim 13, wherein the clamping plate means are displaceable in a vertical direction through the intermediary of the eccentrics.

15. Spinning apparatus as defined in any one of claim 13 or 14, further comprises switching elements for operating the eccentrics.

16. Spinning apparatus as defined in claim 15, wherein the switching element for the eccentrics comprises a pneumatic cylinder.

* * * * *